United States Patent [19]

Graham

[11] Patent Number: 4,697,540

[45] Date of Patent: Oct. 6, 1987

[54] COLLAPSIBLE FOLDAWAY DINGHY

[76] Inventor: Douglas A. Graham, 120 B Station Rd., Great Neck, N.Y. 11023

[21] Appl. No.: 805,619

[22] Filed: Dec. 6, 1985

[51] Int. Cl.[4] ..... B63B 7/00

[52] U.S. Cl. ..... 114/354

[58] Field of Search ..... 114/352–354, 114/363–364, 77 R, 77 A

[56] References Cited

U.S. PATENT DOCUMENTS

| | | | |
|---|---|---|---|
| 2,353,013 | 7/1944 | Clark | 114/354 |
| 2,525,933 | 10/1950 | Nantz | 114/364 |
| 2,966,687 | 1/1961 | Henry | 114/354 |
| 3,648,309 | 3/1972 | Novakovich | 114/354 |
| 3,748,670 | 7/1973 | Musson | 114/354 |

*Primary Examiner*—Joseph F. Peters, Jr.
*Assistant Examiner*—Jesûs D. Sotelo
*Attorney, Agent, or Firm*—Richard L. Miller

[57] ABSTRACT

A collapsible foldaway dinghy is provided and consists of synthetic single skin having panels joined by flexible watertight webs which can be folded into a small package that will fit in a car trunk and cockpit locker. Thwarts having vertical ribs are secured to the sides of dinghy to act as support members and seats.

5 Claims, 7 Drawing Figures

COLLAPSIBLE FOLDAWAY DINGHY

BACKGROUND OF THE INVENTION

The instant invention relates generally to boats and more specifically it relates to a collapsible foldaway dinghy.

Numerous boats have been provided in prior art that are adapted to be assembled for use. For example U.S. Pat. Nos. 3,228,043; 3,639,933 and 3,748,670 all are illustrative of such prior art. While these units may be suitable for the particular purpose to which they address, they would not be as suitable for the purposes of the present invention as heretofore described.

SUMMARY OF THE INVENTION

A principle object of the present invention is to provide a collapsible foldaway dinghy that will overcome the shortcomings of the prior art devices.

Another object is to provide a collapsible foldaway dinghy which can be folded into a small package that will fit in a car trunk or cockpit locker.

An additional object is to provide a collapsible foldaway dinghy fabricated out of durable materials which will float in water and withstand constant use over a long period of time.

A further object is to provide a collapsible foldaway dinghy that is simple and easy to use.

A still further object is to provide a collapsible foldaway dinghy that is economical in cost to manufacture.

Further objects of the invention will appear as the description proceeds.

To the accomplishment of the above and related objects, this invention may be embodied in the form illustrated in the accompanying drawings, attention being called to the fact, however, that the drawings are illustrative only and that changes may be made in the specific construction illustrated and described within the scope of the appended claims.

BRIEF DESCRIPTION OF THE DRAWING FIGURES

The figures in the drawings are briefly described as follows.

DETAILED DESCRIPTION OF THE PREFERRED EMBODIMENT

Figures 1, 2, 3, 4, 5, 6, 7:
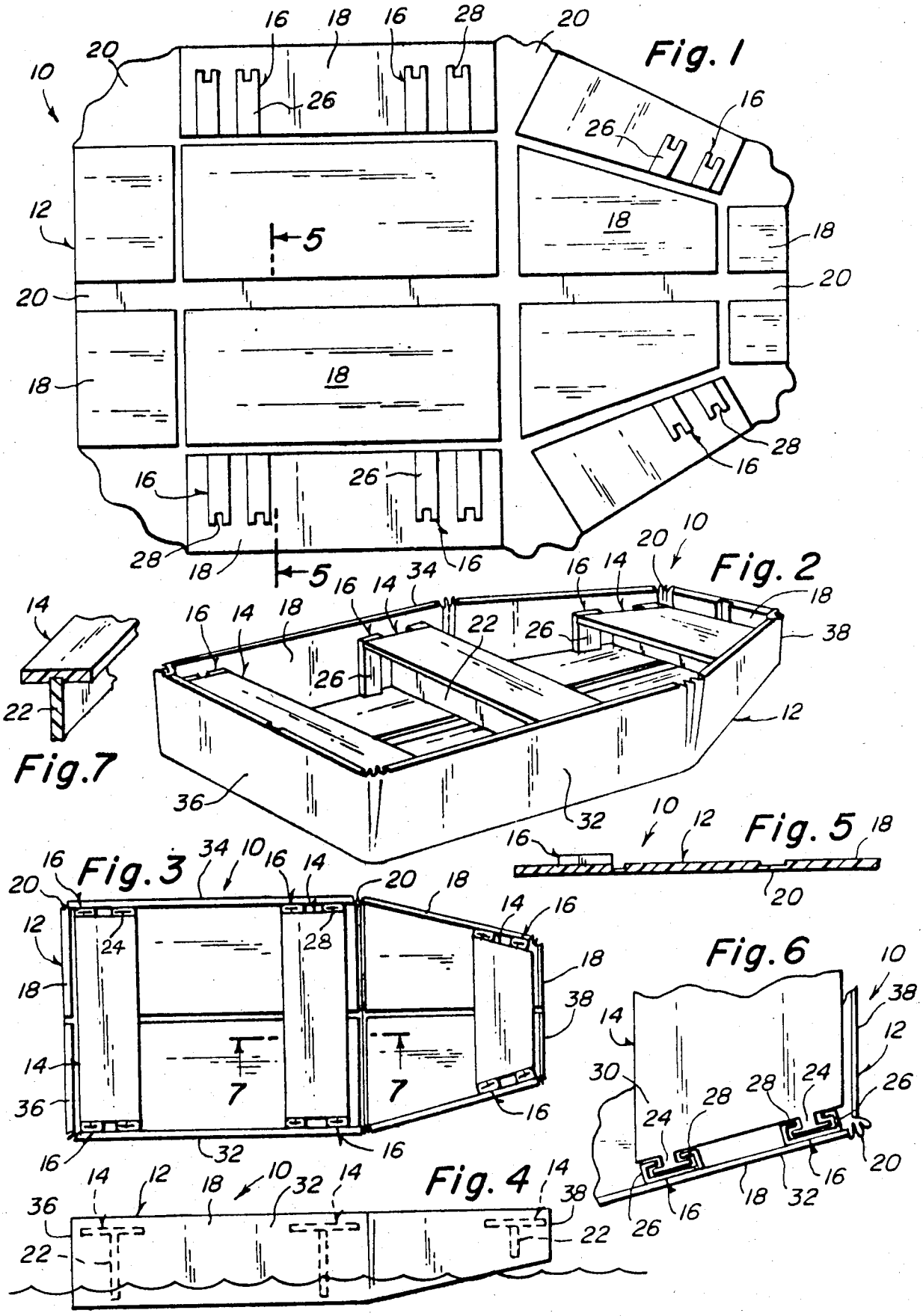
FIG. 1 is a top plan view of the invention shown unfolded into a flat position.
FIG. 2 is a perspective view thereof shown folded into a dingy-shaped vessel.
FIG. 3 is a top plan view thereof.
FIG. 4 is a side elevational view thereof.
FIG. 5 is a cross sectional view taken on line 5—5 of FIG. 1, showing a typical panel and web interconstruction, the illustration being exaggerated for the purpose of clarity and understanding.
FIG. 6 is an enlarged fragmentary top plan view of one corner of the dingy bow, illustrating a typical folding of the web when the panels are erected into the dingy-shape, and also illustrating a typical structure for securement of the seat ends to the dingy side panels.
FIG. 7 is a fragmentary perspective view of the seat partly in cross section as taken on line 7—7 in FIG. 3.

Turning now descriptively to the drawings, in which similar reference characters denote similar elements throughout the several views, FIGS. 1 through 7 illustrate the invention.

The invention which is a collapsible foldaway dinghy 10 basically consists of a synthetic single skin 12, three thwarts 14 and devices 16 for securing the thwarts 14 across opposite sides of the dinghy 10.

The skin 12 has a plurality of panels 18 joined by flexible watertight webs 20 which can be folded upwards to form the dinghy 10 and folded downwards to form a small package that will fit in a car trunk and cockpit locker. Each thwart 14 has a vertical rib 22 extending downwardly. The thwarts will act as support members and seats for the dinghy 10.

The securing devices 16 include a plurality of T-shaped tongues 24 and a plurality of vertical support legs 26, each of which has a T-shaped groove 28. Two tongues 24 are formed on each end 30 of each of the thwarts 14. The legs 26 are formed and positioned on each side of the dinghy 10 so that the tongues 24 can engage with the grooves 28.

When the skin 12 is folded upwards the panels 18 will further form starboard side 32, port side 34, stern 36 and bow 38 of the dinghy 10.

The synthetic single skin 12 can be fabricated out of fiberglass material while the thwarts 14 may also be fabricated out of fiberglass material.

To assemble the dinghy 10 the sides of the skin 12 are folded upwards. The thwarts 14 can then be secured on the legs 26 so that the dinghy can be placed into the water to be used. To disassemble the dinghy 10 the thwarts 14 are removed whereby. the sides of the skin 12 are folded downwards into a small package for storage.

While certain novel features of this invention have been shown and described and are pointed out in the annexed claims, it will be understood that various omissions, substitutions and changes in the forms and details of the device illustrated and in its operation can be made by those skilled in the art without departing from the spirit of the invention.

What is claimed is:

1. A collapsible foldaway dinghy which comprises:

(a) a synthetic single skin having a plurality of panels joined by flexible water tight webs which can be folded upwards to form said dinghy and folded downwards to form a small package that will fit in a car trunk and cockpit locker;

(b) a plurality of thwarts, each said thwart having a vertical rib extending downwardly;

(c) means for securing said thwarts across opposite sides of said dinghy, including retaining means so that said thwarts will hold the opposing sidewalls erect in its upwardly folded condition and act as support members and seats for said dinghy, wherein said securing means includes:

(d) a plurality of T-shaped tongues, two of which are formed on each end of each of said thwarts; and (e) a plurality of vertical support legs each having a T-shaped groove so that said tongues can engage with said said grooves and hold the side walls erect.

2. A collapsible foldaway dinghy as recited in claim 1 wherein said skin is folded upwards said panels will further form starboard side, port side, stern and bow of said dinghy.

3. A collapsible foldaway dinghy as recited in claim 2 wherein said synthetic single skin is fabricated out of fiberglass material.

4. A collapsible foldaway dinghy as recited in claim 3 wherein said thwarts are fabricated out of fiberglass material.

5. A collapsible foldaway dinghy which comprises:

(a) a synthetic single skin having a plurality of panels joined by flexible water tight webs which can be folded upwards to form said dinghy and folded downwards to form a small package that will fit in a car trunk and cockpit locker;

(b) a plurality of thwarts, each said thwart having a vertical rib extending downwardly; and (c) means for securing said thwarts across opposite sides of said dinghy, including retaining means so that said thwarts will hold the opposing sidewalls erect in its upwardly folded condition and act as support members and seats for said dinghy, wherein the sidewalls are formed of two panels with a web joining the panels at a point along the sidewalls to permit the sidewalls forward of the web to be inwardly directed toward each other to thereby form an inwardly bowed forward end of the dinghy.

* * * * *